United States Patent [19]

Moreland

[11] Patent Number: 5,002,190

[45] Date of Patent: Mar. 26, 1991

[54] SPORTS CAP RACK

[76] Inventor: Lonnie Moreland, R.R. #4, Wallaceburg Ontario, Canada, N8A 4L5

[21] Appl. No.: 529,127

[22] Filed: May 25, 1990

[30] Foreign Application Priority Data

Jun. 24, 1988 [CA] Canada ..... 570441

[51] Int. Cl.[5] ..... A47G 25/00

[52] U.S. Cl. ..... 211/32; 211/106; 211/181

[58] Field of Search ..... 211/32, 30, 31, 33, 211/13, 95, 181, 96, 106, 35

[56] References Cited

U.S. PATENT DOCUMENTS

| | | | |
|---|---|---|---|
| 1,069,893 | 8/1913 | Mendelson | 211/32 |
| 1,272,884 | 7/1918 | Allen | 211/32 X |
| 1,984,827 | 12/1934 | Derman | 211/32 X |
| 2,006,033 | 6/1935 | Sharpe | 211/32 |
| 2,963,166 | 12/1960 | Miller | 211/32 |
| 3,108,723 | 10/1963 | Hickey | 211/33 X |
| 4,583,646 | 4/1986 | Bowman | 211/32 |

*Primary Examiner*—Sarah A. Lechok

*Attorney, Agent, or Firm*—Mitches & Co.

[57] ABSTRACT

A hat rack adapted to display at various attitudes, a plurality of different peak caps discloses the use of a single longitudinal element carrying a plurality of secondary elements spacially there along, each of the second elements carrying at least two members, preferrably a curved U shaped member at the distal end of the second element, and a vertical U shaped member, relative to the second longitudinal element, about midway there along the said U shaped elements adapted to specifically carry the peak and body of a single cap.

1 Claim, 1 Drawing Sheet

SPORTS CAP RACK

This is a continuation-in-part application to U.S. Ser. No. 354,767, filed 22 May, 1989, now abandoned.

This invention relates to a Sports Cap Rack.

Those who are collectors of baseball caps and other sport caps have difficulty conveniently displaying them, as they are generally put on hooks which normally take suit coats and the like, or else they are placed on shelves.

Neither of these alternatives effectively display caps and their indicia nor do they occupy minimum space.

I have conceived of a novel cap rack which articulates so that it may be placed in the vertical, horizontal or any intermediate position while at the same time, always holding a cap so the peak is full and the indicia or monogram, that is normally placed on the forehead of the cap, can be clearly visible.

My novel hat rack articulates in a manner which allows the rack itself to be placed at various attitudes while allowing a plurality of caps supported thereby to be spacially disposed always in an upright position. The rack also has the ability of always displaying the cap in an upright position while, when the cap is placed thereon, obscuring or concealing the support structure of the rack. A slim line structure of rack is achieved and is simply constructed by a longitudinal element and a plurality of identical compound U shaped supporting elements which are adapted to pivotly mate into the longitudinal element, and provide the pivoting means and the actual hat support structure. The profile of the compound U element are shaped such that they are safe, in that they do not extensively protrude into space normally occupied by humans particularly when the hat rack is used and mounted in hallways and alike.

The structure of the hat rack lends itself to fabrication of the same from wood, metal, formed wire or steel, plastic.

The invention therefore contemplates a cap rack holder for holding a cap with peak and body in a display position, the holder comprising:

(a) a first longitudinal element with first means for mounting the same on a surface, and a plurality of spatially disposed secondary element support means;

(b) a plurality of secondary support elements each adapted for engagement with one of said secondary element support means each secondary support element including a longitudinal member carrying a first shaped member near its distal end, and a second shaped member at a distance spatially disposed along its length, the second shaped member disposed at an elevation higher than that of the first shaped member whereby the peak of a cap may rest with the peak on the first shaped member, and the body of the cap on the second shaped member; and, (c) wherein the secondary element support means is an aperture defined by the first longitudinal element and the secondary support element includes a male member adapted to matingly nest in said aperture.

Specificaly the first shaped member is preferably arcuate while the second shaped member is U shaped and in an embodiment the second shaped member lies in a plane orthogonal to that of the longitudinal member and the U shaped member has its distal arms at an elevation higher than that of the first shaped member.

The embodiments of the invention will now be described,by way,of example, and reference to the acompanying drawings in which.

Figure 1:
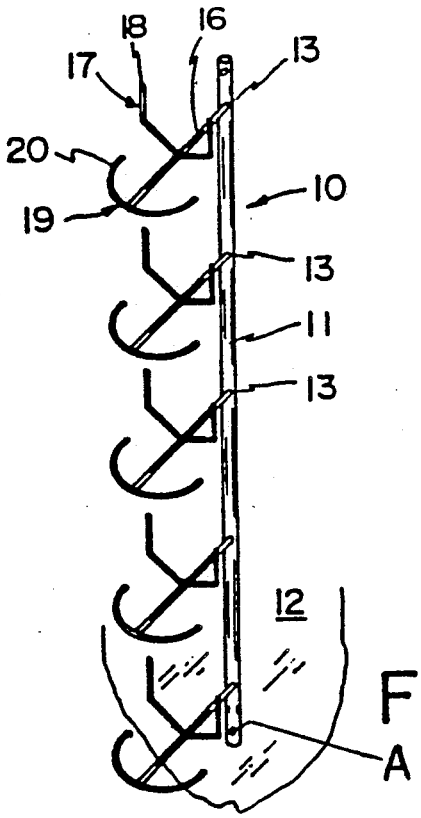
FIG. 1 is a perspective view of my novel articulating hat rack shown in the vertical plane.

Referring to FIG. 1, the cap rack is generally shown as 10 and consists of a longitudinal element 11 defining mounting aperture A as means for securing the element against a wall 12, or other flat surface. The longitudinal element 11 has a plurality of apertures 13 spacially disposed along the length of the element 11. Into each of these apertures 13 a tubular member or dowel piece 16 is secured and the same carries thereon a U shaped element 17 with uprising arms 18, and, a second U shaped element 19 with curved arms 20.

Figure 2:
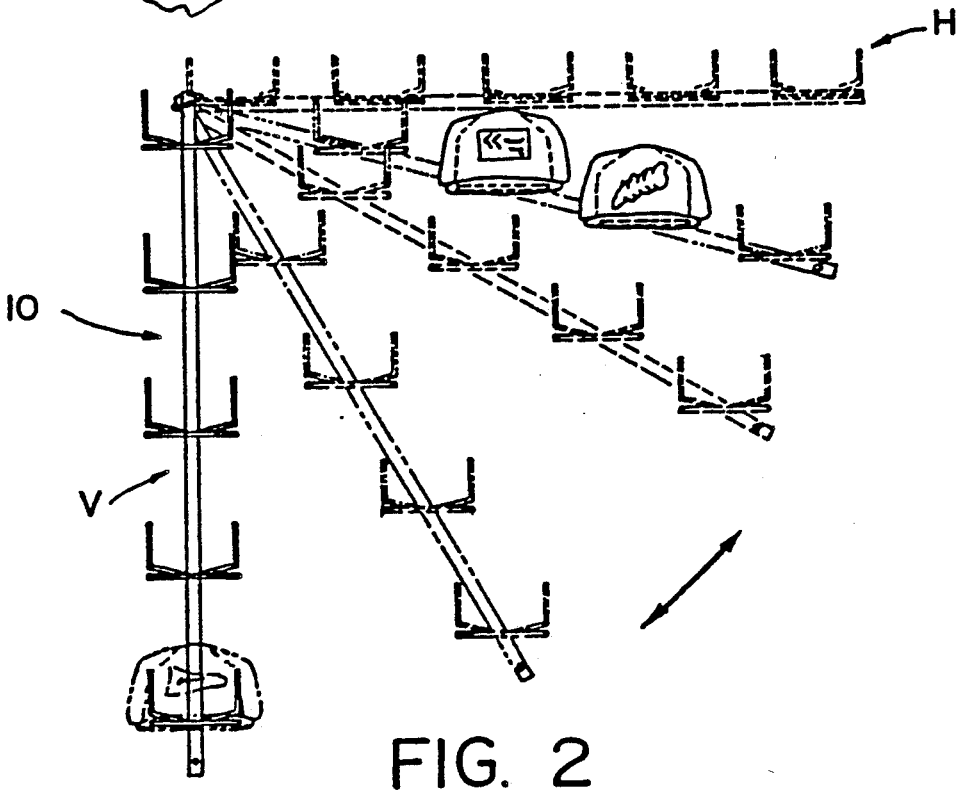
FIG. 2 is a front plan view showing the various articulation of the rack.

Referring to FIG. 2 the cap rack may be mounted in the vertical position, as shown by arrow V or in any of the phantom positions of that figure, including the horizontal position H. In each of its attitudes the U shaped members 19 and 17 may be organized so that they are parallel to the floor and thereby can hold the cap 40 in a parallel attitude as well display the indicia 30 clearly to anyone that can see.

Figure 3:
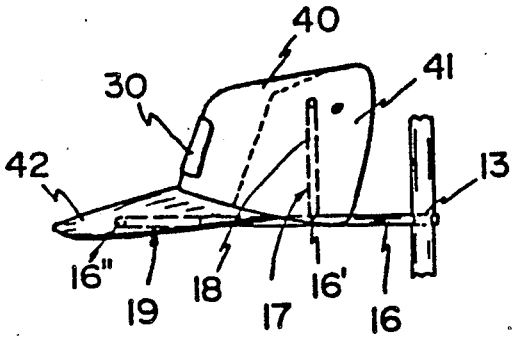
FIG. 3 is a side view of part of the rack of FIG. 1 showing a cap, mounted thereon.

Referring to FIG. 3 the cap 40 is shown with a body portion 41 a peak 42, and indicia panel 30 mounted on the front. The cap peak 42 is adapted to overlay the curved U shaped element 19; and to rest thereupon while the square U shaped element 17 is adapted to have its arms 18 engage into the hat and into the bottom of the top of the cap, thereby holding the cap firm and "open". In this way the front of the cap and the indicia space 30 is clearly visible.

Referring to FIG. 3 the dowel element 16 has an aperture 16' through which passes the U shaped element 17 in a manner that it frictionally engaged with the aperture 16', so that the attitude of the U shaped element 17 may be held generally in the preferred perpendicular position as shown in the figures or in any alternative position or inclined position as may be necessary. This may be necessary from time to time when the depth of the cap is too "shallow" to accomodate the length of the arms 18.

Similarly the U shaped member 19 passes through an aperture 16" near the tip of the longitudinal element or dowel 16. The dowel or tip 16 since it has frictional engagement in the aperture 13 can be adjusted as to its attitude, thereby allowing the hat to sit parallel to the ground in any of its positioned locations set forth in FIG. 2.

Those skilled in the art will appreciate that any swivel attachment means may be replaced for those of the aperture 16'and 16" and that the U shaped members may be composed of rigid material such as wood, formed steel, or wire, plastic, without deviating from the invention.

I claim:

1. A cap rack holder for holding a cap with peak and body in a display position, the holder comprising:

(a) a first longitudinal element having a first means for mounting on a surface, and a plurality of spatially disposed secondary element support means;

(b) a plurality of secondary support elements each adapted for engagement with one of said secondary element support means each secondary support element including a longitudinal member carrying a first shaped member near its distal, end, and a second shaped member at a distance spatially disposed along its lenght, the second shaped member having uprising arm and terminating in a peak disposed at an elevation higher than that of the first shaped member whereby the peak of the cap may rest with its peak on said first shaped member, and the body of the cap on the second shaped member; and, (c) wherein the secondary element support means is an aperture defined by the first longitudinal element and the secondary support element includes a male member adapted to matingly nest in said aperture.

* * * * *